US005201282A

United States Patent [19]

Albrecht

[11] Patent Number: 5,201,282

[45] Date of Patent: Apr. 13, 1993

[54] UPFLOW/DOWNFLOW HEATED TUBE CIRCULATING SYSTEM

[75] Inventor: Melvin J. Albrecht, Homeworth, Ohio

[73] Assignee: The Babcock & Wilcox Company, New Orleans, La.

[21] Appl. No.: 785,147

[22] Filed: Oct. 29, 1991

Related U.S. Application Data

[60] Continuation of Ser. No. 568,921, Aug. 17, 1990, abandoned, which is a division of Ser. No. 422,853, Oct. 17, 1989, Pat. No. 4,982,703.

[51] Int. Cl.[5] ..... F22B 15/00; F22B 7/00

[52] U.S. Cl. ..... 122/406.1; 122/235.23; 122/379

[58] Field of Search ..... 122/406.1, 235.11, 235.23, 122/6 A, 379

[56] References Cited

U.S. PATENT DOCUMENTS

| | | | |
|---|---|---|---|
| 1,743,326 | 1/1930 | Davy | 122/235 |
| 1,795,894 | 3/1931 | Ruhr | 122/235 |
| 2,077,410 | 4/1937 | Hanter et al. | 122/510 |
| 2,893,829 | 7/1959 | Hutton | 23/48 |
| 2,949,099 | 8/1960 | Miller | 122/235 |
| 3,063,431 | 11/1962 | Miller | 122/478 |
| 3,159,146 | 12/1964 | Rudolph | 122/6 A |
| 3,888,213 | 6/1975 | Akturk et al. | 122/478 |
| 4,191,133 | 3/1980 | Stevens | 122/6 A |
| 4,422,411 | 12/1983 | Thorogood | 122/6 A |
| 4,442,800 | 4/1984 | Seifert et al. | 122/379 |
| 4,524,727 | 6/1985 | Ammann | 122/6 A |
| 4,569,680 | 2/1986 | Darling et al. | 122/6 A |

FOREIGN PATENT DOCUMENTS

| | | |
|---|---|---|
| 3022880 | 4/1981 | Fed. Rep. of Germany . |
| 49-15802 | 7/1974 | Japan . |
| 1402719 | 1/1975 | United Kingdom . |

*Primary Examiner*—Henry C. Yuen

*Attorney, Agent, or Firm*—Vytas R. Matas; Robert J. Edwards; Eric Marich

[57] ABSTRACT

A fluid flow circuit for a boiler having a combustion chamber and an exhaust passage. In one embodiment there is provided at least one upflow evaporative generating bank module in the exhaust passage and at least one downflow evaporative generating bank module in the exhaust passage, positioned downstream of the upflow module. One or more upper downcomers are connected to a steam drum and supply water to the lower header of the upflow module and to the upper header of the downflow module. If needed, the convection pass wall enclosures can also be fed by the upper downcomers to their upper inlet headers. One or more lower downcomers may be connected to each lower header of the downflow module (and to the lower outlet headers of the convection pass wall enclosures) for supplying the water to a plurality of furnace circuits which extend along the combustion chamber in the boiler. The opposite end of each furnace circuit is connected to one or more risers which, in turn, are connected to the steam drum. The upper header of the upflow module is also connected to the steam drum through one or more risers for completing the circuit.

2 Claims, 4 Drawing Sheets

UPFLOW/DOWNFLOW HEATED TUBE CIRCULATING SYSTEM

This is a continuation of application Ser. No. 07/568,921, filed Aug. 17, 1990, now abandoned, which was a division of application Ser. No. 07/422,853, filed Oct. 17, 1989, now U.S. Pat. No. 4,982,703.

FIELD AND BACKGROUND OF THE INVENTION

The present invention relates in general to circuit designs for boilers, and in particular to a new and useful circulation system for the heated tubes for absorbing heat in a furnace.

Furnace circuits that receive heat, and fluid flow from a low elevation to a high elevation are referred to as "upflowing circuits" and circuits that receive heat, and fluid flow from a high elevation to a low elevation are referred to as "downflowing circuits". A circuit is made up of a tube or a group of tubes that originates at a common point such as a header or a drum, and terminates at a common point that could also be either a header or a drum.

In most natural circulation boiler designs, the heated tubes that compose the evaporative portion of the design are configured for upflow of the fluid, the exception being the heated downcomer tubes of the generating bank(s) on multi-drum boilers. In this type of boiler the heated downcomer tubes provide the total circulation flow for the furnace and the evaporative generating bank riser tubes.

In FIG. 1 the circulation concept of a typical industrial boiler is shown. In this concept, subcooled water from a steam drum 10 enters the heated evaporative generating bank downcomer tubes 12 in the exhaust passage 20 of the furnace. The water travels down the tubes of this bank and is collected in the lower drum 14 of the bank. The enthalpy of the water that exits into the lower drum 14 has increased due to the heat that was absorbed by each tube 12 in the bank. The water in the lower drum 14 could either be subcooled or saturated, depending upon the amount of heat absorbed. The mixture that leaves the lower drum 14 will either travel up the evaporative generating bank riser tubes 16 or down the large tubes or pipes 18 called downcomers. The liquid that travels up the riser tubes 16 absorbs heat and exits into the steam drum 10. The liquid that travels down the downcomers 18 reaches the furnace inlet headers 19 either through direct connection of the downcomer 18 to the inlet header 19 or through intermediate supply tubes 22 that feed the liquid to specific inlet headers. The liquid that enters an inlet header 19 is distributed to the furnace tubes 24 that are connected to the inlet header 19. The tubes of the furnace are heated by the burning of the fuel in the combustion chamber 30 of the furnace. The absorption of heat by the furnace tubes 24 causes the liquid in the tubes 24 to boil resulting in a two-phase mixture of water and steam. The two-phase mixture in the tubes 24 reaches the steam drum 10 either through direct connection of the tubes 24 with the steam drum 10 or through intermediate riser tubes 26 that transmit the two-phase mixture from outlet headers 28 of the furnace circuits to the steam drum 10. Internal separation equipment within the steam drum 10 separates the two-phase mixture into steam and water. Subcooled feedwater that is discharged from the feedpipe (not shown) in the steam drum 10 and the saturated liquid that is discharged from the separation equipment are mixed together to yield a subcooled liquid that exits the steam drum 10 by way of the downcomer tubes 12, thus completing the circulation flow loop for this concept.

For evaporative boiler generating bank modules and selected furnace and convection pass wall enclosures subject to the flow of the combustion gases, a threshold heat input is required to adequately circulate the fluid in all the tubes in the module and in the convection pass wall enclosure circuits in upflow while avoiding flow instability. As used herein, convection pass wall enclosure refers to the various structures formed by tubes conveying a fluid and which pick up heat primarily via convective heat transfer between the gas stream and the tubes, and which serve to at least partially define the exhaust passage or passages of the boiler. For certain designs, it is impossible to circulate all the tubes in the evaporative modules or convection pass wall enclosures in upflow without changing to a more expensive module or wall enclosure geometry (thicker tubes for increasing tube flow velocity, taller module or wall enclosure height, reduced system flow resistance through the addition of circulation system pressure part connections, etc.).

In most natural circulation designs, as an alternative to more expensive evaporative modules, economizer surface may be added to absorb the additional heat required to meet the desired boiler outlet gas temperature. When economizer surface is added, the economizer outlet water temperature increases. The economizer outlet water is fed to the steam drum. If the economizer outlet water temperature reaches the saturation temperature of the liquid in the steam drum, then the circulation system of the boiler will receive no subcooling from the feedwater that enters the drum. The subcooling that the feedwater system delivers to the steam drum provides a portion of the 'pumping' head that is needed to make the circulation system operate. When the subcooling is not available due to a saturated or near saturated economizer outlet water temperature, achieving adequate boiler circulation and desired boiler efficiency (outlet gas temperature) will require increased boiler cost since it will be necessary to either reduce the economizer outlet temperature (e.g. by using water coil air heaters) or add circulation system pressure part connections, with their additional increased cost.

SUMMARY OF THE INVENTION

One aspect of the present invention is to incorporate selective downflow and upflow circuits together so that the circulation system for each selected group of downflow/upflow circuits is independent from each other. This concept can be used for many types of boiler designs (e.g., Radiant Boilers, Stirling Power Boilers, Circulating Fluidized Bed Boilers, Process Recovery Boilers, Municipal Solid Waste and Turbine Exhaust Gas Boilers).

The downflow evaporative modules and downflow convection pass wall enclosure circuits of the present invention solve the economic problem of minimizing unit cost for desired boiler efficiency, by avoiding unit-specific cost increases which are needed to make an evaporative boiler generating bank module or convection pass wall enclosure flow up, or by avoiding the cost of adding economizer surface as in the prior art.

According to the invention, water from the steam drum is fed by downcomers to both the lower inlet headers of the upflow generating bank modules and the upper inlet headers of the downflow generating bank modules. Additionally, if needed, the downflow convection pass wall enclosure circuits can also be fed by downcomers to their upper inlet headers, causing them to convey the subcooled water therethrough in a downward direction. The present invention can be selectively applied to some or all of the evaporative generating bank modules and/or to some or all of the convection pass wall enclosure circuits as necessary, depending upon the requirements of a given boiler.

The water that enters the lower headers of the upflow generating bank modules travels up the tubes of the modules, absorbing heat along the way. A two-phase mixture is created by the water's absorption of the heat in the tubes. The two-phase mixture exits the tubes and enters the outlet headers of the upflow generating bank modules. The two-phase mixture is transferred to the steam drum by riser tubes.

The water entering the upper inlet headers of the downflow generating bank modules is distributed to the tubes that make up the circuitry of these modules. The water travels down the tubes of these modules and is collected in the lower outlet headers of the modules. Similarly, the water that enters the upper inlet headers of the downflow convection pass wall enclosures circuitry is distributed to the tubes comprising these circuits. The water travels down the downflow convection pass wall enclosure circuit tubes and is collected in the downflow convection pass wall enclosure circuit lower outlet headers. The enthalpy of the water at the outlet headers has increased due to the heat that was absorbed in each circuit. However, the water at the outlet headers will generally be subcooled in that he heat absorbed by the modules or downflow convection pass wall enclosures is less than that needed to heat the water to saturation temperature.

The upflow generating bank modules, if provided, will generally be placed upstream (with respect to the flow of combustion gases) of the downflow generating bank modules. This placement would be utilized if there is sufficient heat in the combustion gases to exceed the threshold heat input required to adequately circulate the module in upflow while avoiding flow instability. If the heat input at a given location is below the threshold value, however, all the generating bank modules from that point on would be configured as downflow generating bank modules. Thus, if the heat input upstream of all the generating bank modules is below the threshold value, all the generating bank modules would be configured as downflow generating bank modules.

From the outlet headers of the downflow generating bank modules, and from the outlet headers of the downflow convection pass wall enclosure circuits, the lower downcomers and supply tubes are used to feed the furnace circuits of the boiler. The two-phase mixture that is generated in the furnace circuits is transferred to the steam drum by riser tubes.

Internal separating equipment within the steam drum separates the mixture into steam and water. Subcooled feedwater that is discharged from the feedpipe in the drum and the saturated liquid that is discharged from the separation equipment are mixed together to give a subcooled liquid that exits the drum by way of the downcomer tubes, thus completing the circulation flow loop of the invention.

The various features of novelty which characterize the invention are pointed out with particularity in the claims annexed to and forming a part of this disclosure. For a better understanding of the invention, its operating advantages and specific aspects attained by its uses, reference is made to the accompanying drawings and descriptive matter in which the preferred embodiments of the invention are illustrated.

DESCRIPTION OF THE PREFERRED EMBODIMENTS

Figure 1:
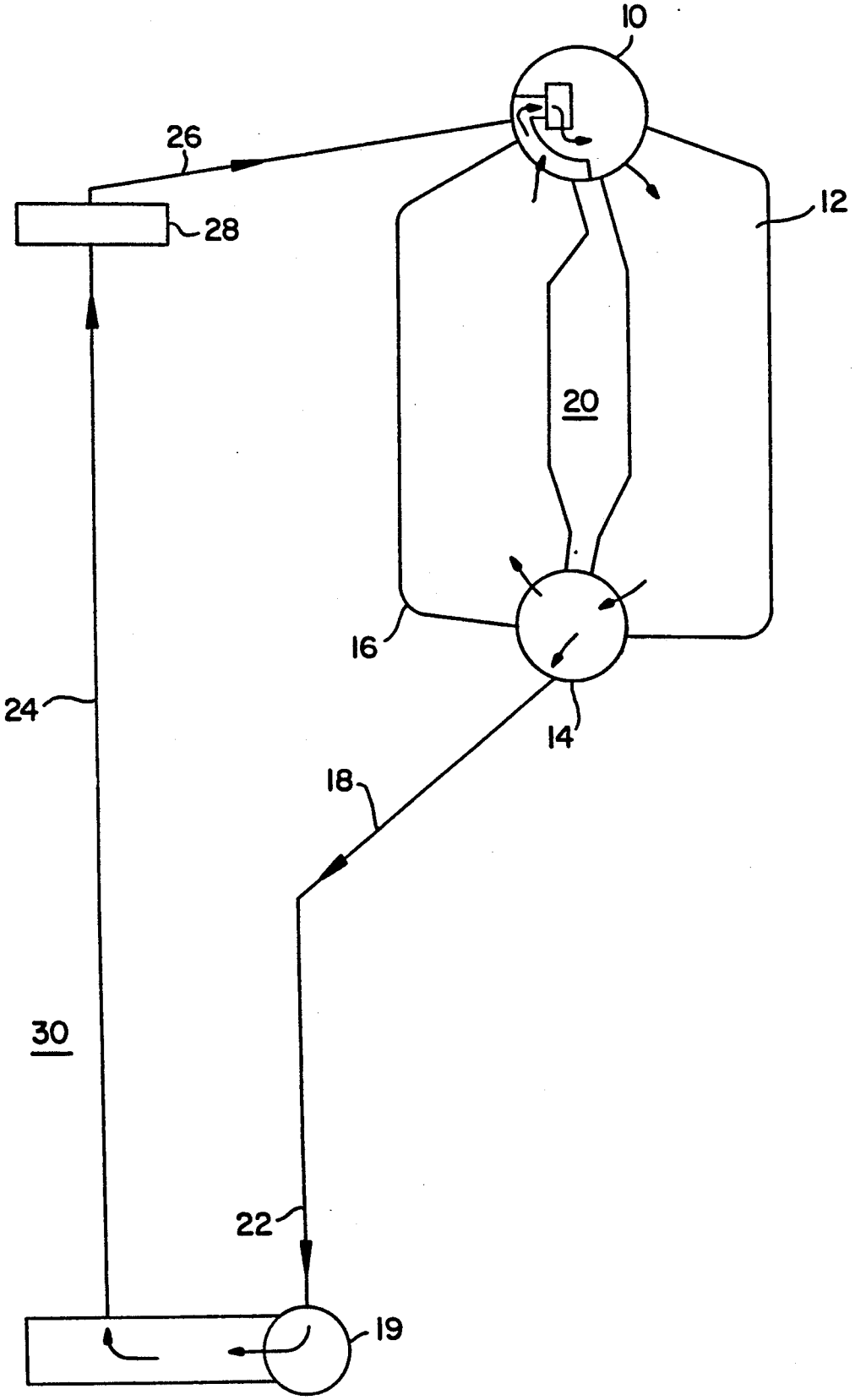
FIG. 1 PRIOR ART
FIG. 1 is a schematic representation of the heated tube circuit for a conventional industrial boiler.
Figure 2:
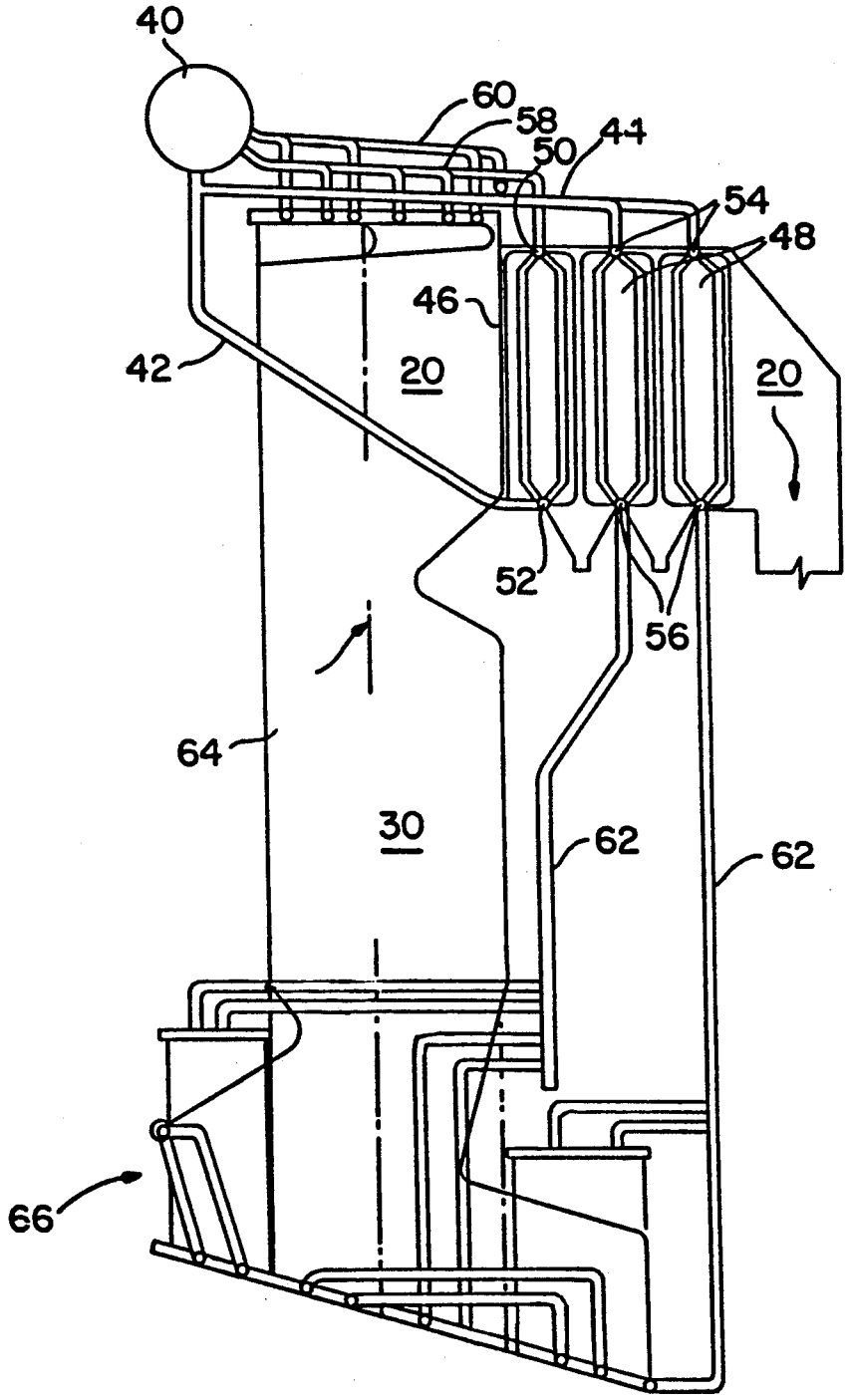
FIG. 2 is a side elevational view of a heated tube circuit in a furnace according to the present invention.

Referring to the drawings in general and to FIG. 2 particular, the invention embodied in FIG. 2 comprises a fluid flow circuit for a boiler having a combustion chamber 30 and an exhaust passage 20. The fluid flow circuit of the present invention includes a steam drum 40 of conventional design. First and second upper downcomers 42 and 44 are connected to the steam drum 40 for receiving subcooled water therefrom. Additional upper downcomers can be employed if desired. First and second riser tube assemblies 58 and 60 are likewise connected to the steam drum 40 for returning a two-phase mixture of saturated water and saturated steam to the steam drum 40. Additional riser tube assemblies can be employed if desired.

A single upflow evaporative generating bank module 46 is positioned in the exhaust passage 20 and includes a lower inlet header 52 which is connected to the upper downcomer 42, and an upper outlet header 50 which is connected to the first riser tube assembly 58.

A pair of downflow evaporative generating bank modules 48 are also positioned in the exhaust passage 20, at a location downstream (with respect to the flow of combustion gases shown by the arrows) of the upflow module 46. Each downflow module 48 includes an upper inlet header 54 and a lower outlet header 56. The downflow module inlet headers 54 are each connected to the second upper downcomer 44 for receiving subcooled water from the steam drum 40. The subcooled water is further heated in the exhaust passage 20 and supplied as feed water to a pair of lower downcomers 62. Additional lower downcomers can be employed if desired. Lower downcomers 62 are connected to various supply tube assemblies generally designated 66 which supply the lower end of multiple furnace circuits 64 extending along the combustion chamber 30 for absorbing heat generated in the combustion chamber 30. The upper ends of the furnace circuits 64 are connected to the riser tube assemblies 58 and 60, which feed the two-phase mixture of water and steam to the steam drum 40.

Figure 3:
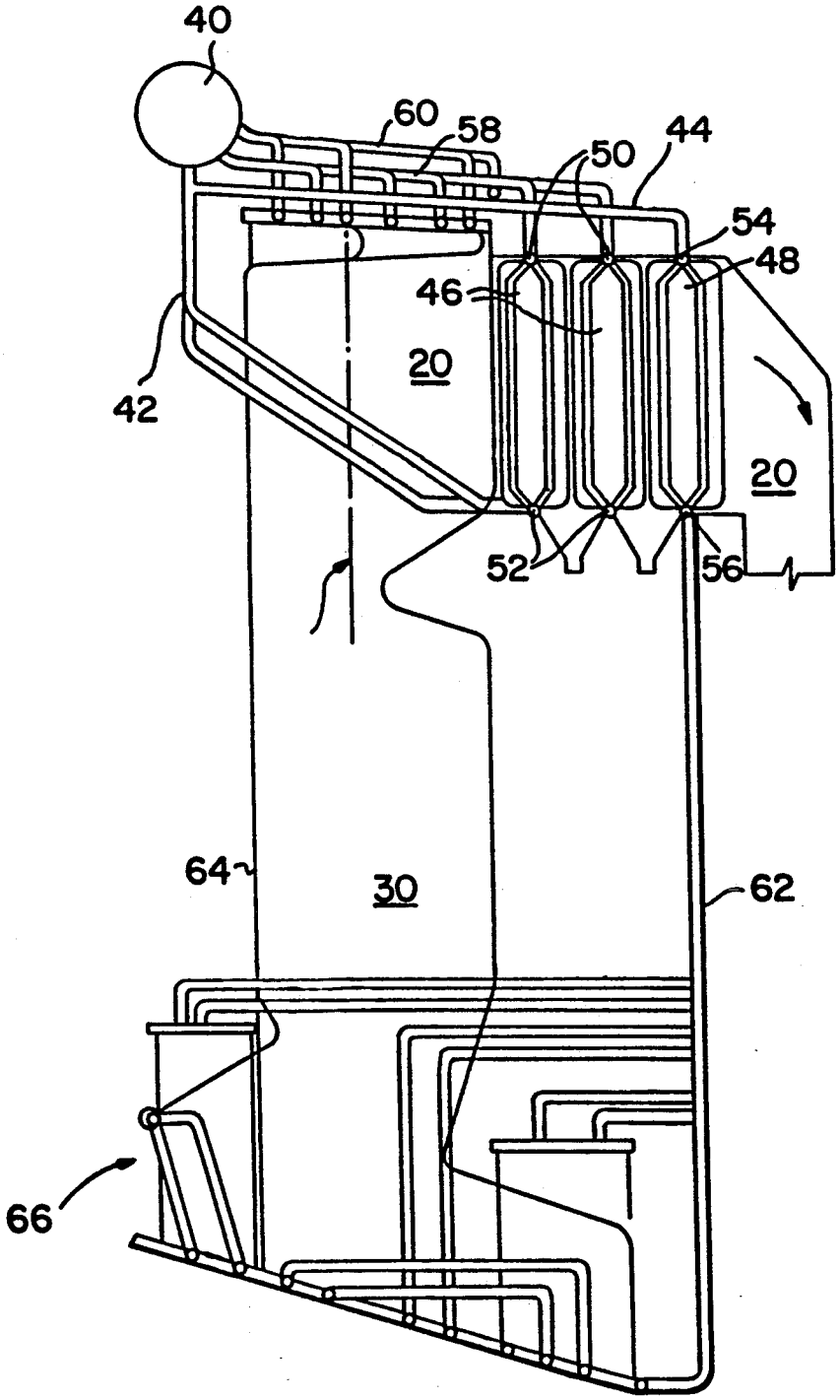
FIG. 3 is a view similar to FIG. 2 of another embodiment of the invention.

FIG. 3 shows an alternate embodiment of the invention wherein the same reference numerals are utilized and which designate the same or similar parts. In FIG. 3, two upflow modules 46 are positioned at an upstream location in exhaust passage 20 while a single downflow module 48 is positioned in the exhaust passage 20, downstream of the upflow modules 46. The remaining connections are the same as in the embodiment of FIG. 2.

Figure 4:
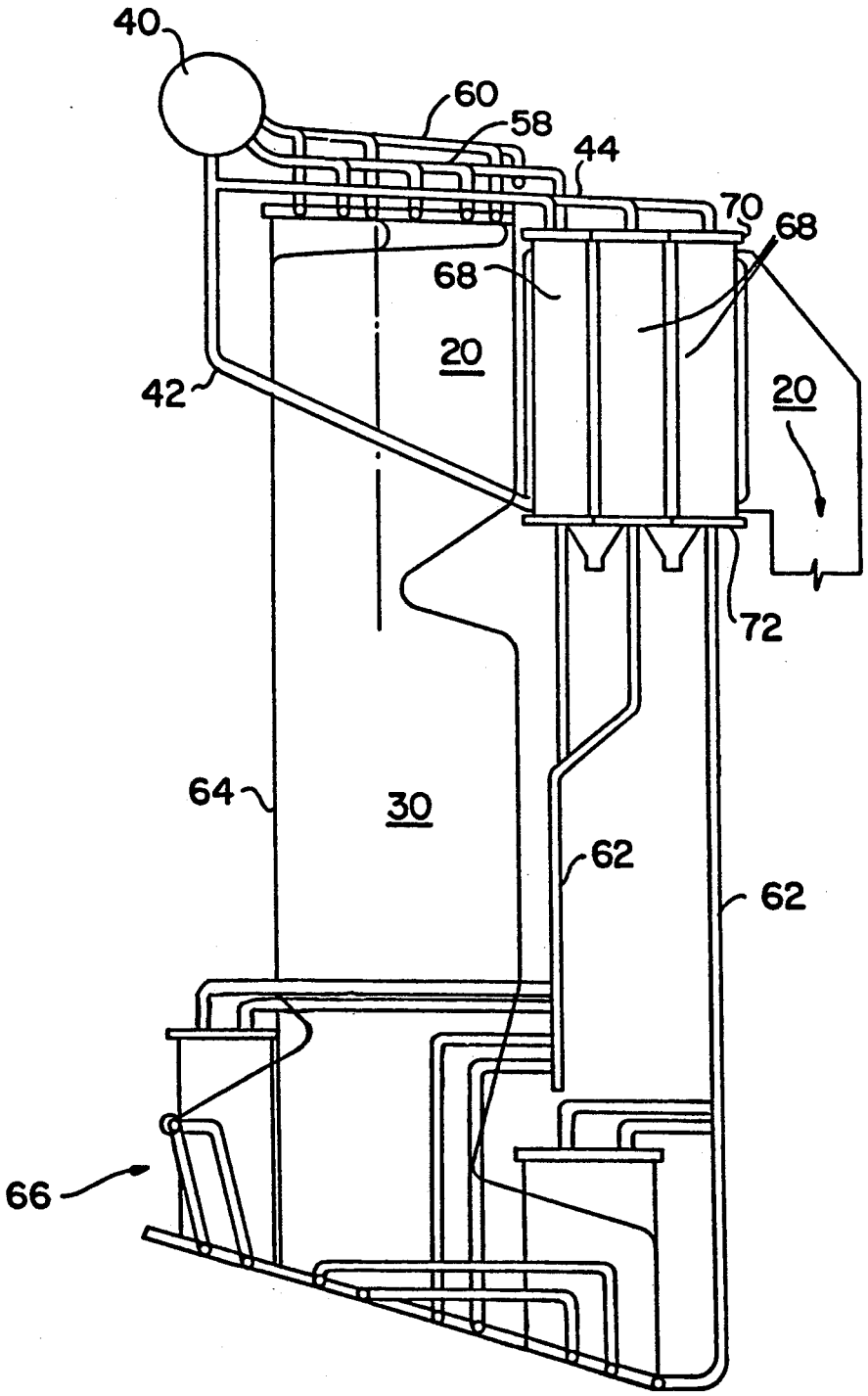
FIG. 4 is a side elevational view of a heated tube circuit in a furnace according to the present invention, in which the evaporative generating bank modules have been omitted for clarity and which shows the application of the present invention to a typical downflow convection pass wall enclosure circuit.

FIG. 4 shows a side elevational view of a heated tube circuit in a furnace according to the present invention, in which the upflow and downflow generating bank modules 46, 48 have been omitted for clarity, to show the application of the present invention to a typical downflow convection pass wall enclosure circuit 68. In FIG. 4, three such downflow convection pass wall enclosure circuits 68 have been shown each having an upper header 70 and a lower header 72, which are positioned and which partially define the exhaust passage 20. Upper downcomers 44 which are used to feed the downflow generating bank modules 48, are also employed to feed subcooled water to the downflow convection pass wall enclosure circuits 68. Similarly, lower downcomers 62 which were previously described as being connected to the lower outlet headers 56 to receive heated water from the downflow generating bank modules 48, are also employed and connected to the convection pass wall enclosure circuit lower header 72 to receive water from the circuits 68. The remaining connections are the same as in the embodiments of FIGS. 2 and 3.

It is understood that the present invention can thus be applied to some or all of the evaporative generating bank modules without the similar application of this concept to the convection pass wall enclosure circuits, or for the invention to be applied only to the convection wall pass enclosure circuits without application to the evaporative generating bank modules, or only selectively to some circuits of either type and in any combination. It is also understood that while the convection pass wall enclosure circuits 68 have been shown as the side walls partially defining the exhaust passage 20, the concept could be equally applied to some or all convection pass wall enclosure circuits, such as roof enclosures, floor enclosures, baffle walls, division walls, or other structures which divide the gas flow into more than one flow path, which serve to partially define the exhaust passage 20, where the outlet headers 72 of such circuit is at a lower elevation than the inlet header 70 of such a circuit.

It will thus be seen that the present invention allows for adequate natural circulation of separate flow circuits in a boiler without the use of expensive module or wall enclosure geometry. As such, the present invention can be easily adapted to existing or new construction, by allowing the natural flow characteristics of each independent group of downflow/upflow circuits to guide their design. Accordingly, while specific embodiments of the invention have been shown and described in detail to illustrate the application of the principles of the invention, it will be understood that the invention may be embodied otherwise without departing from such principles.

I claim:

1. A fluid flow circuit for a boiler having a combustion chamber for producing a flow of combustion gases and an exhaust passage, comprising:

a steam drum for separating steam from water;

upper downcomers connected to said steam drum for receiving water therefrom;

at least one downflow evaporative generating bank module having an upper header and a lower header, and positioned at a location in the exhaust passage for absorbing heat where the heat in the flow of combustion gases from the combustion chamber is below a threshold heat input required to adequately circulate the module in upflow while avoiding flow instability, at least one of said upper downcomers being connected to said downflow module upper header to receive said water;

riser means connected to said steam drum for returning a mixture of saturated steam and water to said steam drum;

lower downcomers connected to said downflow module lower header; and at least one furnace circuit extending along the combustion chamber for receiving heat therefrom, and having a lower end connected to said lower downcomers and an upper end connected to said riser means.

2. A fluid flow circuit according to claim 1, including a plurality of furnace circuits, and a plurality of supply tube assemblies connected between said lower downcomers and said plurality of furnace circuits.

* * * * *